US005192254A

United States Patent [19]

Young

[11] Patent Number: 5,192,254

[45] Date of Patent: Mar. 9, 1993

[54] FACIAL EXERCISE SENSOR

[76] Inventor: Sharon Young, 1315 Crossfield, Katy, Tex. 77450

[21] Appl. No.: 487,765

[22] Filed: Mar. 2, 1990

[51] Int. Cl.[5] ..... A63B 23/03

[52] U.S. Cl. ..... 482/8; 482/74; 482/909; 128/782; 340/689

[58] Field of Search ..... 272/95; 482/1, 3, 8, 482/9, 49, 74, 10, 11, 909, 148; 128/721, 728, 782; 340/689

[56] References Cited

U.S. PATENT DOCUMENTS

| | | | |
|---|---|---|---|
| 3,517,999 | 6/1970 | Weaver | 128/782 X |
| 3,813,096 | 5/1974 | Welch | 272/95 |
| 4,088,128 | 5/1978 | Mabuchi | 128/52 |
| 4,189,141 | 2/1980 | Rooney | 272/95 |
| 4,195,833 | 4/1980 | Svendsen | 272/95 |
| 4,196,524 | 4/1980 | Bechtel | 340/689 X |
| 4,371,945 | 2/1983 | Karr et al. | 482/74 X |
| 4,392,126 | 7/1983 | Loyola | 128/782 X |
| 4,409,992 | 10/1983 | Sidorenko et al. | 482/74 X |
| 4,487,207 | 12/1984 | Fitz | 128/728 |
| 4,536,755 | 8/1985 | Holzgang et al. | 340/689 X |
| 4,566,461 | 1/1986 | Lubell et al. | 482/8 X |
| 4,572,197 | 2/1986 | Moore et al. | 128/721 X |
| 4,597,394 | 7/1986 | Sackner | 128/782 X |
| 4,613,130 | 9/1986 | Watson | 482/49 X |
| 4,665,928 | 5/1987 | Linial et al. | 482/1 X |
| 4,666,148 | 5/1987 | Crawford | 272/95 |
| 4,730,625 | 3/1988 | Fraser et al. | 128/782 |
| 4,757,453 | 7/1988 | Nasiff | 128/782 |
| 4,776,323 | 10/1988 | Spector | 482/3 X |
| 4,807,640 | 2/1989 | Watson et al. | 128/782 X |
| 4,817,628 | 4/1989 | Zealear et al. | 128/282 X |
| 4,836,219 | 6/1989 | Hobson et al. | 128/782 |
| 4,841,954 | 6/1989 | Kalsi | 128/36 |
| 4,846,459 | 7/1989 | Vivian | 482/74 |
| 4,867,442 | 9/1989 | Matthews | 482/8 |
| 4,871,998 | 10/1989 | Chaillou | 128/782 X |
| 4,914,423 | 4/1990 | Fernandez | 128/782 X |
| 4,938,476 | 7/1990 | Brunelle et al. | 128/721 X |
| 5,027,688 | 7/1991 | Suzuki et al. | 128/782 X |

*Primary Examiner*—Robert Bahr

*Attorney, Agent, or Firm*—Pravel, Gambrell, Hewitt, Kimball & Krieger

[57] ABSTRACT

A sensor device to detect and signal the exercise or movement of a subject's craniofacial and cervical muscles that includes a trigger attached to the subject, sensitive to movement in at least one direction and communicating with a signal emitter in order to emit an appropriate signal upon the sensing of movement that indicates the performance of the exercise.

14 Claims, 3 Drawing Sheets

FACIAL EXERCISE SENSOR

BACKGROUND OF THE INVENTION

This invention relates to devices that sense the exercise of muscles and, more particularly, to devices that sense and signal the performance of craniofacial and cervical muscle-toning exercises.

The value of physical exercise has received increased recognition in recent years. This recognition of the value of such exercise includes the recognition of the value of craniofacial and cervical muscle exercises, referred to generally hereafter as facial exercises. It is believed that facial exercise contributes to the toning of facial muscles with the result that people feel and look more alert, healthy, and vital. Such toning of the muscles is reported to give the face a firm look of alert, youthful energy.

In particular, in regard to the value of facial exercise, one can refer to the book *Youth Lift* by M. J. Saffon and Constance Schnader, 1981, Warner Books, Inc., 75 Rockefeller Plaza, New York, N.Y. 10019. The authors describe how to firm the neck, chin, and shoulders with minutes-a-day exercises. The exercises are recommended both in lieu of a face lift or in conjunction with a face lift.

One exercise recommended by such book to firm the entire mouth area and beautify the mouth is to form the lips into an extreme pointed pout. The lips are to be pushed out as far as possible to stretch and smooth the smiling grooves and lines that extend between the nose and the corners of the mouth. The upper lip is to be curled upward and the lower lip downward and the position held for a period of time, relaxed and repeated. To smooth and firm the cheeks and jaw line, the authors recommend pressing the lips and moving the mouth and jaw as far to one side as possible. The cheek is to be sucked against the teeth on the opposing side while the position is held for a period, relaxed and repeated. To firm sagging cheeks, the lips are to be pushed forward and formed in a slight pucker such that the syllable "O" can be pronounced. In this position, the lips are to be moved from one side of the face as far as possible. To tighten flabby skin and erase wrinkles in front of the ears, one is to yawn as far as open as possible and then slowly close the mouth, while fighting against letting the teeth meet. Each of the above exercises is illustrated in the book with a picture of the face when the exercise is properly performed.

It is customary to prescribe practicing facial exercises, such as the above, in front of a mirror. The mirror provides visual feedback as to whether the exercise is being performed in accordance with illustrative pictures. One drawback to this customary practice, and a drawback that provides a disincentive to perform the daily facial exercises is the physical restriction of maintaining prolonged visual contact with a mirror. The muscle exercise sensor device of the present invention overcomes this drawback. It allows one the physical freedom to move about, and even to perform other chores, while at the same time to receive feedback that one is performing the desired facial exercises. Feedback as to whether the desired exercise is being performed comes in the way of an audible, visual, or tactile signal.

The present invention also has application with those whose facial muscles have been impaired by injury or illness. The invention will aide the doctor to encourage exercise of those facial muscles which have been injured or diseased. For the patient, it will register immediate indications of success and progress. In this case, the function of the sensor might be to detect any movement at all of the facial muscles, not necessarily specific facial exercises. When the term "facial exercises" is used herein, the word exercise should be understood to refer not only to ordinary exercises but also, in some cases, simple movement.

SUMMARY OF THE INVENTION

The present invention comprises a sensor device to be worn by a subject that includes an attachment means to enable locating at least one sensing trigger in the vicinity of portions of facial muscle groups that the subject wearer desires to exercise. The sensing trigger communicates with a signal emitter that may, but need not, be located with the trigger. The trigger can detect motion of the appropriate muscles in at least one direction, which motion indicates that a desired facial exercise is being performed. Detecting the motion, the trigger activates the signal emitter that is powered to emit a signal to let the wearer know that the exercise is being performed. Preferably, the signal is audible, for its aesthetic value. A tactile or visual signal would also perform the function.

The attachment means may be adjustable to the subject's face and head. Further, the trigger location on the attachment means is preferably adjustable. Multiple triggers may be employed, connected either to one or to multiple signal senders and/or powering means. The powering means is preferably a 1.5 volt battery.

DESCRIPTION OF THE PREFERRED EMBODIMENT

Figure 1:
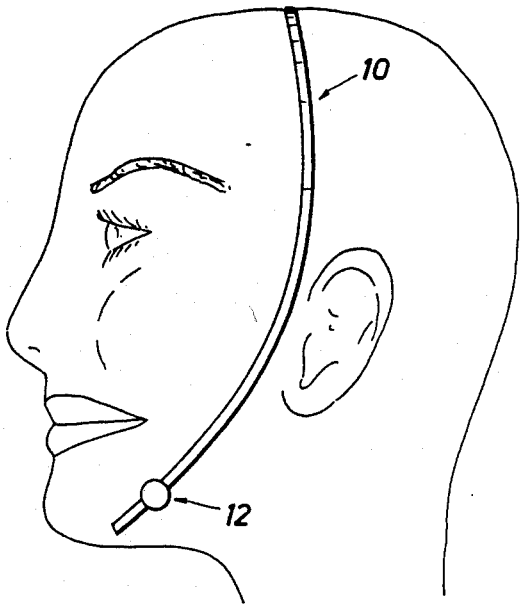
FIG. 1 shows a side view of one sensor element attached to attachment means upon the head.
Figure 2:
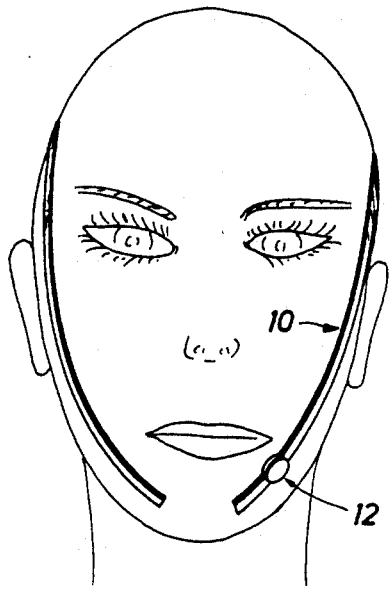
FIG. 2 shows a frontal view of one sensor element attached to attachment means upon the head.
Figure 3:
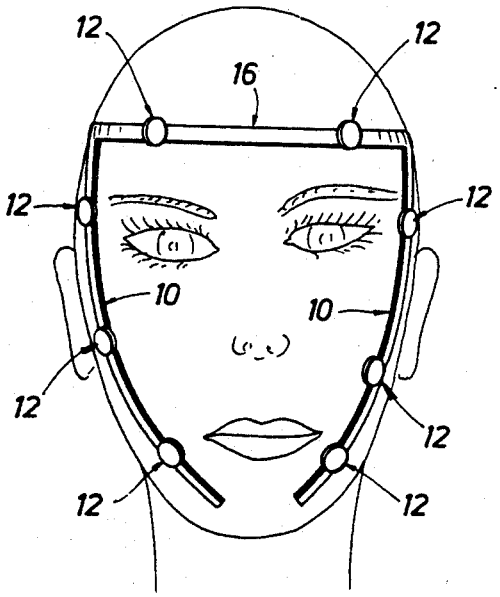
FIG. 3 shows a frontal view of multiple sensor element attached to attachment means upon the head.
Figure 4:
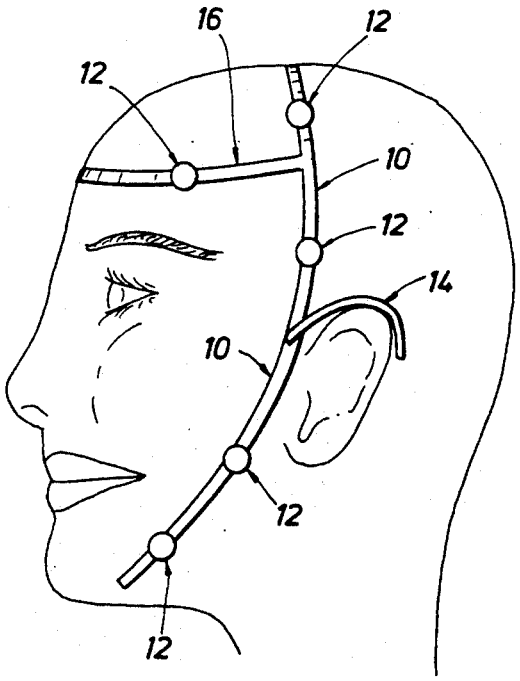
FIG. 4 shows a side view of multiple sensor element attached to attachment means upon the head.

FIGS. 1 and 2 illustrate an embodiment of the sensory device of the present invention that includes one sensor element 12 located upon attachment means 10 affixed to a subject's head. FIGS. 3 and 4 illustrate how the sensory device may be comprised of multiple sensor elements 12 located along attachment means 10. Each sensor element 12 in these figures comprises a trigger, a signal means, and a power means.

The attachment means 10 may be comprised of a flexible semi-rigid plastic that can be bent to the shape of the user's head and face. One material suitable for the attachment means is hollow ridged PVC ¼" with ½" inside measurement. The attachment means may further include a cross piece 16 that fits over the forehead and adjustable ear pieces 14, as illustrated in FIGS. 3 and 4. Whereas, the attachment means of the preferred embodiment is comprised of flexible material that may be shaped to roughly conform to the user's head and face, it should be understood that the device also functions when a sensor element is attached to the skin by such attachment means as tape.

Figure 5:
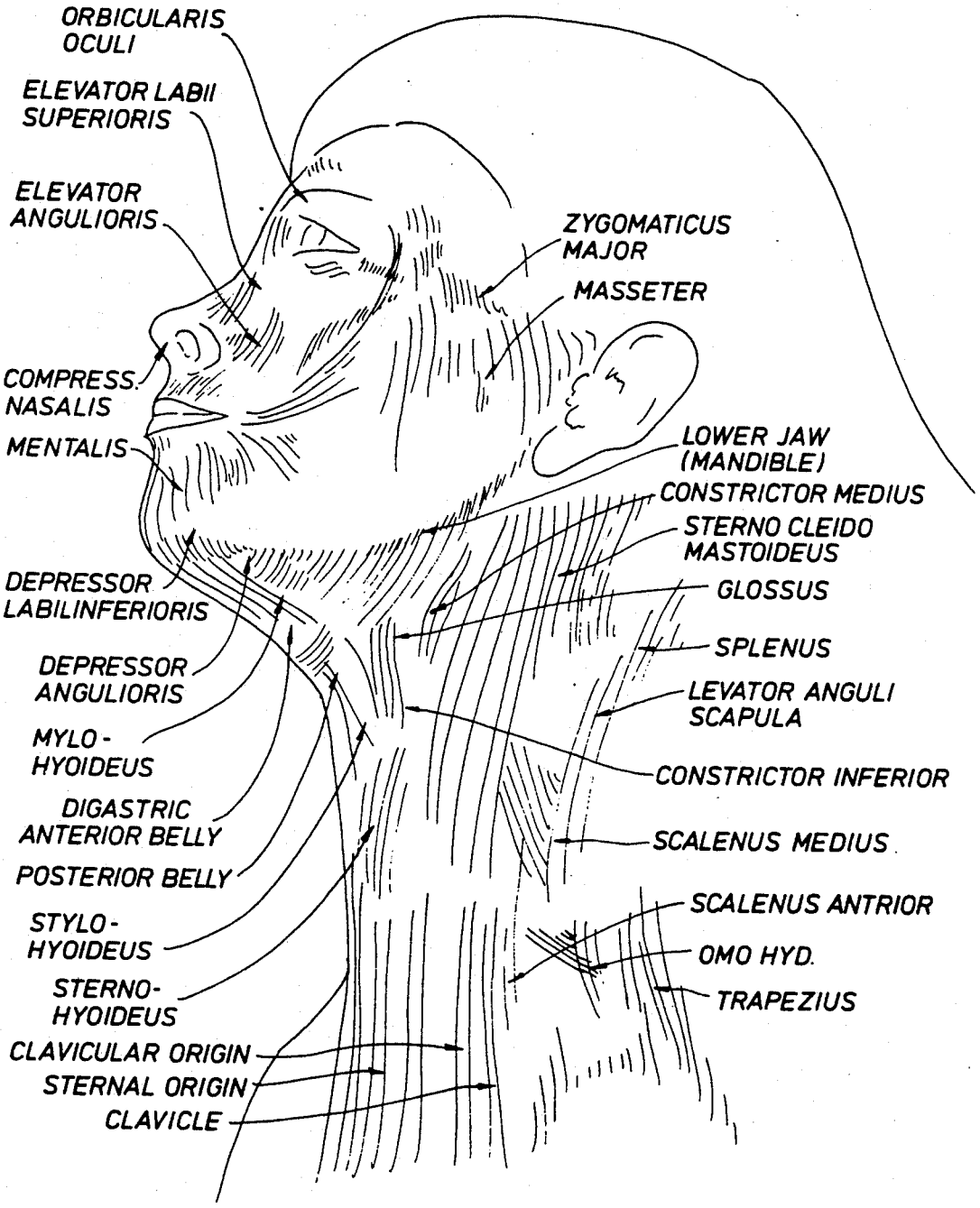
FIG. 5 shows the muscular construction underlying the skin of the face and neck.

If the attachment means is roughly fixed with respect to the head and face, then preferably sensor elements 12, or at least the trigger T, can be adjusted in its location along the attachment means. The proper location of the sensor elements or trigger with respect to the face is a function of the muscles, as illustrated in FIG. 5, that the user wishes to exercise, as well as a function of the type of trigger utilized.

Figure 6:
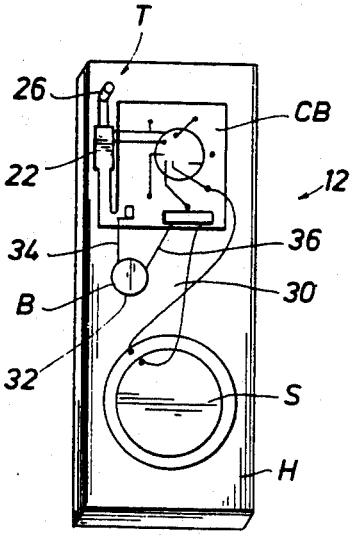
FIG. 6 is a schematic of one embodiment of a sensor element.

FIG. 6 illustrates one embodiment of a sensor element 12. This sensor element 12 is comprised of a housing H in which is located a signal sender, a battery and a trigger. The signal sender includes signaling means S, attached by wires 30 and 32 to circuit system CB, which in turn is connected by conducting lines 34 and 36 to battery B. Battery B is a typical 1.5 V watch-type battery. Circuit system CB is shown overlaying trigger T. No claim is being made per se to the particular circuitry of the signal sender with circuit CB disclosed in the preferred embodiment. Such a combination of trigger, battery and signal sender can be purchased and is found in children's toys, greeting cards and novelty gifts. The device disclosed in the preferred embodiment was manufactured by CALFAX.

Figure 10:
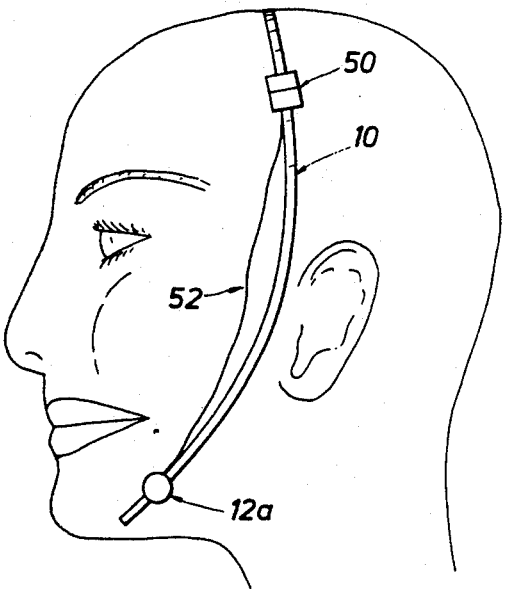
FIGS. 10 and 11 illustrate the device where the trigger is located separately from the signal sender and the power means.
Figure 11:
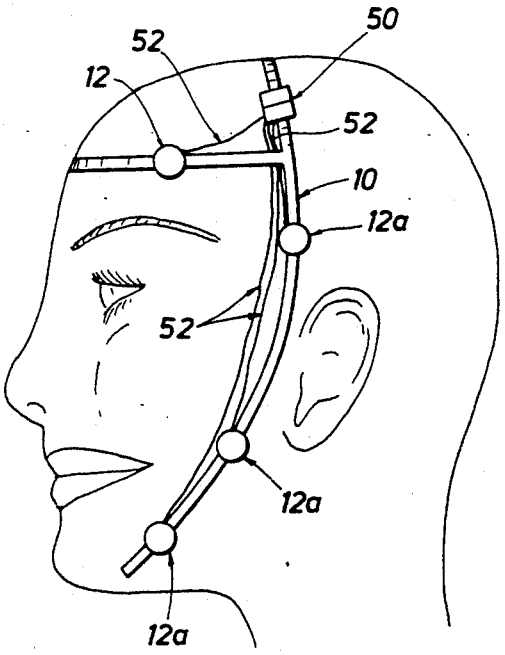

It should be remembered that only trigger T needs to be located on the attachment means at location 12*a*, which is specifically located with respect to the muscles to be exercised. Battery B, circuit system CB and signalling means S can be located elsewhere in communication with trigger T, such as at location 50 toward the top of the head on attachment means 10. This is illustrated in FIGS. 10 and 11. Multiple triggers can communicate with one signal sending means. In FIGS. 10 and 11, location 50 contains the signal sending means S and the power means B. Location(s) 12*a* contains the trigger(s) T. Communication between S/B and T is by lines 52.

Figure 7:
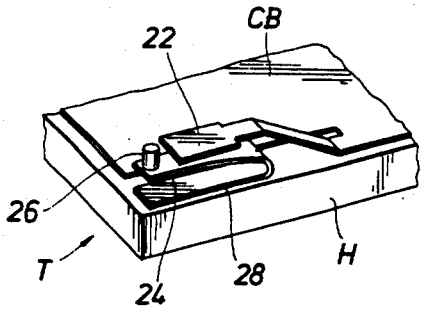
FIG. 7 illustrates the trigger of the above sensor element.
Figure 8:
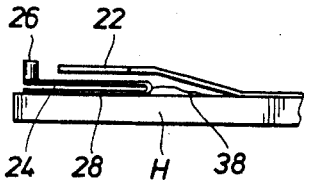
FIGS. 8 and 9 illustrate further the trigger for the above sensor element in its open and closed positions, respectively.
Figure 9:
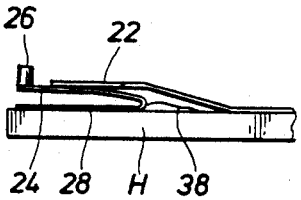

FIGS. 7, 8, and 9 further illustrate the interaction of circuit system CB with trigger T in housing H in the embodiment where S, B, CB, and T are all located in one sensor element. Trigger T is comprised of small solid metal cylinder 26 attached to the end of a metal strip 24 that is connected to base 28 located in the base of housing H. With no downward pressure on cylinder 26 (illustrated in FIG. 9) strip 24 flexes away from base 28 and touches contact 22, lying above flexible metal strip 24 in circuit system CB. Contact 22 is attached to circuit system CB upon the upper surface of housing H. A bore is created in housing H to permit cylinder 26 to flex on band 24 between a raised position, shown in FIG. 9, and a lowered position, shown in FIG. 8. In the raised position, strip 24 touches contact 22 of the circuit system CB and closes the circuit of the sensor S. In the lowered position, metal strip 24 does not touch contact 22, creating an "open circuit." Base 24 is connected to the circuitry of the sensor by conducting line 38. When metal strip 24 is touching contact 22, the circuit is closed between the conducting line 38 and the circuit system CB. When metal strip 24 is not touching contact 22, the circuit between conducting line 38 and circuit system CB containing conductor 22 is broken.

In operation, the attachment band 10 is fitted securely to the head and sensor element 12 is located with respect to a group of muscles that it is desired to exercise. In the preferred embodiment, illustrated sensor element 12 is located on the attachment band between the band and the face and touching the face such that pressure between the skin and the attachment means pushes cylinder 26 of trigger T into housing H toward base 28 and away from contact 22 on circuit system CB, thereby opening the circuit.

When a proper exercise of the facial muscle around sensor element 12 is effected, the muscle is stretched, depressing the plane of the face under sensor element 12 and permitting cylinder 26 of trigger T to move away from base 28 and into contact 22 on circuit system CB. The circuit then becomes closed. Power from battery B reaches signaling means S through circuit system CB. Musical bars are played, as dictated by circuit system CB, and detected by the wearer.

Having described the invention above, various modifications of the techniques, procedures, material, and equipment will be apparent to those in the art. It is intended that all such variations within the scope and spirit of the appended claims be embraced thereby.

What is claimed is:

1. A sensor device to detect and signal the exercise of a subject's craniofacial and cervical muscles that comprises:

a flexible, semi-rigid, U-shaped band shaped and dimensioned to fit over a portion of a subject's head and face;

a trigger housing adjustably attachable to the band along the length of the band;

a trigger attached to the housing, located to interface between the face and the housing and sensitive to movement with respect to the band, said trigger not sensitive to gravity;

a signal emitter in communication with the trigger that emits a signal upon the sensing of movement by the trigger; and means for powering the signal sender.

2. The device of claim 1, wherein the signal sender emits an audible signal.

3. The device of claim 2, wherein the audible signal is musical.

4. The device of claim 1, wherein the signal sender emits a visually observable signal.

5. The device of claim 1, wherein the signal sender emits a tactile signal to the subject's skin.

6. The device of claim 1, wherein the means for powering the signal sender comprises a battery.

7. The device of claim 6, wherein the battery is a 1.5 volt battery.

8. The device of claim 6, wherein the battery is a solar battery.

9. The device of claim 1, wherein the means for powering the signal sender comprises mechanical means.

10. The device of claim 9, wherein the mechanical means comprises a spring.

11. The device of claim 1, wherein the trigger comprises a switch in an electrical circuit that is biased open and that is closed by movement of a portion of the trigger.

12. The device of claim 11, wherein the switch is closed by movement of a portion of the trigger in a direction perpendicular to the band surface.

13. The device of claim 11, wherein the switch is closed by movement of a portion of the trigger in a direction parallel to the band surface.

14. The device of claim 1, wherein the power means and the signal sender are located on the attachment means.

* * * * *